US008317946B2

(12) United States Patent
Arai et al.

(10) Patent No.: US 8,317,946 B2
(45) Date of Patent: Nov. 27, 2012

(54) SEAMLESS STEEL PIPE AND METHOD FOR MANUFACTURING THE SAME

(75) Inventors: Yuji Arai, Amagasaki (JP); Takashi Takano, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 13/090,297

(22) Filed: Apr. 20, 2011

(65) Prior Publication Data

US 2011/0247733 A1 Oct. 13, 2011

Related U.S. Application Data

(63) Continuation of application No. PCT/JP2009/069942, filed on Nov. 26, 2009.

(30) Foreign Application Priority Data

Nov. 26, 2008 (JP) ..... 2008-300802

(51) Int. Cl.

| | |
|---|---|
| ***C22C 38/44*** | (2006.01) |
| ***C22C 38/46*** | (2006.01) |
| ***C22C 38/50*** | (2006.01) |
| ***C21D 8/10*** | (2006.01) |

(52) U.S. Cl. ..... 148/335; 148/593; 148/909

(58) Field of Classification Search ..... 148/320, 148/335, 590, 593

See application file for complete search history.

(56) References Cited

U.S. PATENT DOCUMENTS

2002/0150497 A1 10/2002 Hagen et al.
2005/0076975 A1 * 4/2005 Lopez et al. ..... 148/593

FOREIGN PATENT DOCUMENTS

| | | |
|---|---|---|
| EP | 0828007 A1 * | 3/1998 |
| JP | 61-238917 | 10/1986 |
| JP | 05-051699 | 3/1993 |
| JP | 07-331381 | 12/1995 |
| JP | 09-025518 | 1/1997 |
| JP | 09-0249935 | 9/1997 |
| JP | 11-050148 | 2/1999 |
| JP | 2000-119749 | 4/2000 |
| JP | 2002-194501 | 7/2002 |
| JP | 2007-196237 | 8/2007 |
| JP | 2007-262468 | 12/2007 |

* cited by examiner

*Primary Examiner* — Deborah Yee
(74) *Attorney, Agent, or Firm* — Clark & Brody

(57) ABSTRACT

A seamless steel pipe of a low-alloy steel consisting, by mass %, of C: 0.10 to 0.20%, Si: 0.05 to 1.0%, Mn: 0.05 to 1.2%, Ni: 0.02 to 1.5%, Cr: 0.50 to 1.50%, Mo: 0.50 to 1.50%, Nb: 0.002 to 0.10%, Al: 0.005 to 0.10%, and either or both of Ti: 0.003 to 0.050% and V: 0.01 to 0.20%, the balance being Fe and impurities, the impurities containing 0.025% or less of P, 0.005% or less of S, 0.007% or less of N, and less than 0.0003% of B, wherein the tensile strength is 950 MPa or more and the yield strength is 850 MPa or more, and the Charpy absorbed energy at −40° C. is 60 J or more. This seamless steel pipe may further contain one or more of Cu: 0.02 to 1.0%, Ca: 0.0005 to 0.0050%, and Mg: 0.0005 to 0.0050%. The present invention also provides a method for manufacturing the above-described seamless steel pipe.

5 Claims, 1 Drawing Sheet

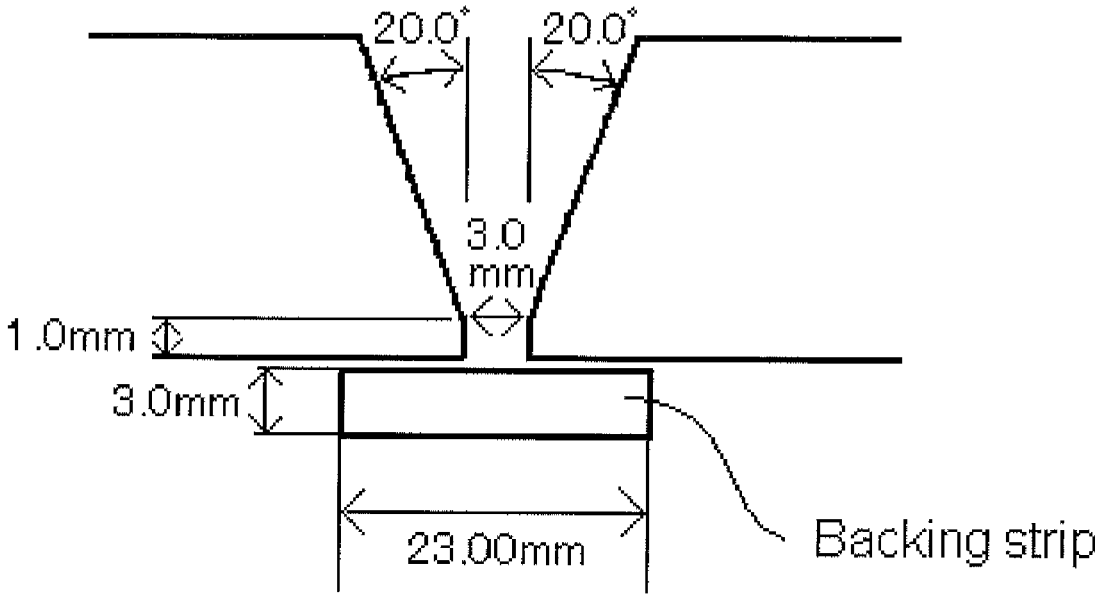
20.0°
20.0°
3.0
mm
1.0mm
3.0mm
23.00mm
Backing strip

SEAMLESS STEEL PIPE AND METHOD FOR MANUFACTURING THE SAME

TECHNICAL FIELD

The present invention relates to a high-strength and high-toughness seamless steel pipe for a machine structural member, especially for a crane boom.

BACKGROUND ART

Among machine structural members, many of cylindrical members have conventionally been obtained from a steel bar into a desired shape by forging or elongating and rolling, or further by cutting, and thereafter heating bar to provide mechanical properties necessary for the machine structural member. In recent years, as structures tend to increase in size and in yield stress, an attempt has been made to reduce the weight of structure by replacing the cylindrical structural member with a hollow-shell seamless steel pipe. In particular, the steel pipe used as a cylindrical structural member such as a crane boom has been required to have high strength and high toughness in view of the increase in size of a crane, the operation on high-rise buildings and in cold districts, and the like. Recently, in the application to a boom, the seamless steel pipe has been required to have a tensile strength of 950 MPa or more and an excellent toughness at a temperature as low as −40° C. In such an application, the steel pipe having a wall thickness of about 5 to 50 mm, especially 8 to 45 mm, has been required in many cases.

As for the high-strength and high-toughness steel pipe, various techniques have conventionally been proposed.

For example, Patent Document 1 proposes a method for manufacturing a high-tension seamless steel pipe excellent in low-temperature toughness, in which a low-alloy steel containing C, Si, Mn, P, S, Ni, Cr, Mo, Ti, Al and N, and either or both of Nb and V, at predetermined content ranges, and further containing 0.0005 to 0.0025% of B is subjected to pipe-making and thereafter heat treated.

Patent Document 2 proposes a high-strength and high-toughness seamless steel pipe manufactured from a steel containing C, Si, Mn, P, S, Al, Nb and N, or further containing at least one selected from Cr, Mo, Ni, V, REM, Ca, Co and Cu, at predetermined content ranges, and further containing 0.0005 to 0.0030% of B, and furthermore containing Ti within the range of $-0.005\% < (Ti-3.4N) < 0.01\%$, in which the size of the precipitate formed by precipitation due to tempering is 0.5 μm or less.

Also, Patent Document 3 proposes a technique for obtaining a high-strength seamless steel pipe by using a low-alloy steel containing C, Si, Mn, P, S, Al, Cr, Mo, V, Cu, N and W at predetermined content ranges to make a pipe, and by quenching and tempering the pipe.

Further, Patent Document 4 proposes a high-strength seamless steel pipe for machine structural use excellent in toughness and weldability, which is obtained by using a steel containing C, Mn, Ti and Nb at predetermined content ranges, and containing Si, Al, P, S and N so that the content ranges thereof are limited to predetermined limits or less, and further containing at least one selected from Ni, Cr, Cu and Mo, and furthermore containing 0.0003 to 0.003% of B, and by making a pipe by using the steel and thereafter subjecting the pipe to accelerated cooling and air cooling, so that the steel has a single self-tempered martensitic micro-structure or a mixed micro-structure of self-tempered martensitic micro-structure and lower bainite.

DOCUMENT LIST

Patent Document

[Patent Document 1]: JP61-238917A
[Patent Document 2]: JP7-331381A
[Patent Document 3]: US2002/0150497A
[Patent Document 4]: JP2007-262468A

DISCLOSURE OF THE INVENTION

Technical Problem

According to the techniques proposed in Patent Documents 1 to 3, a seamless steel pipe having an excellent low-temperature toughness can be obtained. However, all of these techniques relate to a seamless steel pipe having a tensile strength of about 90 kgf/mm$^2$ Therefore, if it is desired to obtain a steel pipe having a much higher strength, the possible decrease of low-temperature toughness cannot be denied.

Also, according to Patent Document 4, as described in example thereof, a seamless steel pipe having a tensile strength exceeding 1000 MPa and a high toughness of 200 J or more in Charpy absorbed energy at −40° C. can be obtained. However, since the pipe is used as acceleratedly cooled, the problem is that the yield stress may reduce to 850 MPa or less.

The present invention has been made in view of the above circumstances, and accordingly an objective thereof is to provide a seamless steel pipe that is suitable for a machine structural member, especially for a crane boom and the like, and is required to have a high strength: the tensile strength of 950 MPa or more and the yield strength of 850 MPa or more, and a high toughness.

As described above, in the application to a crane boom and the like, the steel pipe having a wall thickness of about 5 to 50 mm, especially 8 to 45 mm, has been required. With the increase in wall thickness, it becomes difficult to secure a cooling rate near the central portion in the wall thickness direction during quenching, and therefore it becomes very difficult to secure strength or toughness.

The present invention especially aims to secure high strength and high toughness even for a steel pipe having such a wall thickness.

Solution to Problem

To achieve the above objectives, the present inventors prepared a 100-kg ingot for each of the steel types given in Table 1 by vacuum melting to study the effect of steel component of a quenched and tempered steel having a tensile strength of 950 MPa or more on low-temperature toughness.

TABLE 1

| Steel | Chemical composition (mass %, the balance being Fe and impurities) | | | | | | | | | | |
|---|---|---|---|---|---|---|---|---|---|---|---|
| No. | C | Si | Mn | P | S | Cu | Ni | Cr | Mo | V | Ti |
| 1 | 0.13 | 0.29 | 0.79 | 0.012 | 0.0028 | 0.20 | 0.10 | 0.52 | 0.50 | 0.05 | 0.021 |
| 2 | 0.13 | 0.28 | 0.81 | 0.014 | 0.0027 | 0.20 | 0.10 | 0.52 | 0.72 | 0.05 | 0.021 |
| 3 | 0.16 | 0.29 | 1.01 | 0.011 | 0.0029 | 0.19 | 0.05 | 1.01 | 0.51 | 0.05 | 0.011 |
| 4 | 0.16 | 0.30 | 1.01 | 0.012 | 0.0026 | 0.20 | 0.05 | 1.01 | 0.73 | 0.05 | 0.010 |

TABLE 1-continued

| | | | | | | | | | | | |
|---|---|---|---|---|---|---|---|---|---|---|---|
| 5 | 0.13 | 0.29 | 0.83 | 0.013 | 0.0025 | 0.13 | 0.70 | 0.50 | 0.31* | 0.04 | 0.020 |
| 6 | 0.13 | 0.29 | 0.82 | 0.012 | 0.0026 | 0.13 | 0.70 | 0.40* | 0.50 | 0.04 | 0.020 |
| 7 | 0.17 | 0.27 | 1.11 | 0.014 | 0.0018 | 0.19 | 0.05 | 1.55* | 1.55* | 0.04 | 0.011 |
| 8 | 0.16 | 0.28 | 1.02 | 0.018 | 0.0013 | 0.01 | 0.01* | 1.02 | 0.70 | 0.10 | 0.007 |
| 9 | 0.17 | 0.29 | 0.62 | 0.019 | 0.0013 | 0.03 | 0.15 | 1.43 | 0.70 | 0.02 | 0.008 |
| 10 | 0.17 | 0.29 | 0.62 | 0.017 | 0.0014 | 0.04 | 0.15 | 1.42 | 0.70 | 0.10 | 0.007 |
| 11 | 0.17 | 0.28 | 0.30 | 0.016 | 0.0013 | 0.40 | 0.80 | 1.45 | 0.70 | 0.02 | 0.007 |
| 12 | 0.17 | 0.29 | 0.60 | 0.016 | 0.0016 | 0.19 | 0.05 | 1.41 | 0.69 | 0.01 | 0.001* |
| 13 | 0.17 | 0.28 | 0.61 | 0.017 | 0.0015 | 0.19 | 0.05 | 1.44 | 0.70 | 0.05 | 0.000 |
| 14 | 0.17 | 0.29 | 1.12 | 0.017 | 0.0016 | 0.05 | 0.10 | 1.42 | 0.50 | 0.06 | 0.004 |
| 15 | 0.17 | 0.28 | 0.20 | 0.016 | 0.0015 | 0.10 | 0.10 | 1.01 | 0.55 | 0.23* | 0.008 |
| 16 | 0.16 | 0.29 | 0.05 | 0.016 | 0.0015 | 0.40 | 0.40 | 1.00 | 0.72 | 0.10 | 0.007 |
| 17 | 0.16 | 0.29 | 0.20 | 0.016 | 0.0013 | 0.10 | 0.10 | 1.02 | 0.70 | 0.10 | 0.007 |
| 18 | 0.13 | 0.29 | 0.82 | 0.012 | 0.0081* | 0.13 | 0.71 | 0.51 | 0.50 | 0.04 | 0.019 |

| Steel | Chemical composition (mass %, the balance being Fe and impurities) | | | | | | $Ac_1$ point | $Ac_3$ point |
|---|---|---|---|---|---|---|---|---|
| No. | Nb | Ca | Mg | B | sol-Al | N | (° C.) | (° C.) |
| 1 | 0.032 | 0.0019 | | 0.0016* | 0.027 | 0.0055 | 760 | 886 |
| 2 | 0.031 | 0.0029 | | 0.0015* | 0.027 | 0.0052 | 764 | 894 |
| 3 | 0.033 | 0.0018 | | 0.0001 | 0.027 | 0.0053 | 771 | 867 |
| 4 | 0.033 | 0.0026 | | 0.0001 | 0.024 | 0.0050 | 777 | 876 |
| 5 | 0.032 | 0.0015 | | 0.0001 | 0.027 | 0.0048 | 744 | 864 |
| 6 | 0.002 | 0.0016 | | 0.0001 | 0.027 | 0.0046 | 739 | 871 |
| 7 | 0.033 | 0.0016 | | 0.0001 | 0.038 | 0.0063 | 805 | 896 |
| 8 | 0.004 | 0.0019 | | 0.0002 | 0.039 | 0.0063 | 770 | 878 |
| 9 | 0.005 | 0.0031 | | 0.0001 | 0.038 | 0.0059 | 784 | 875 |
| 10 | 0.007 | 0.0019 | | 0.0001 | 0.035 | 0.0063 | 782 | 875 |
| 11 | 0.006 | 0.0018 | | 0.0001 | 0.038 | 0.0064 | 765 | 858 |
| 12 | 0.001* | 0.0018 | | 0.0002 | 0.037 | 0.0064 | 782 | 875 |
| 13 | 0.052 | 0.0018 | | 0.0001 | 0.037 | 0.0069 | 793 | 875 |
| 14 | 0.004 | | 0.0021 | 0.0002 | 0.039 | 0.0067 | 773 | 859 |
| 15 | 0.004 | 0.0022 | | 0.0001 | 0.041 | 0.0068 | 760 | 870 |
| 16 | 0.004 | 0.0001 | | 0.0001 | 0.039 | 0.0060 | 764 | 881 |
| 17 | 0.004 | | 0.0020 | 0.0001 | 0.041 | 0.0060 | 775 | 890 |
| 18 | 0.002 | 0.0019 | | 0.0001 | 0.027 | 0.0048 | 741 | 871 |

*shows out of the scope of the invention.

The ingot was hot forged into a block shape, and thereafter was hot rolled to form a 200 mm-thick plate. The plate was quenched and tempered to obtain a heat-treated plate. A No. 10 test specimen specified in JIS Z2201 (1998) was cut out of the central portion in the wall thickness direction of the heat-treated plate in parallel to the roll longitudinal direction, and a tensile test was conducted in conformity to JIS Z2241 (1998). Also, a 2-mm V-notch full size test specimen conforming to JIS Z2242 was cut out of the central portion in the wall thickness direction of the heat-treated plate in parallel to the roll width direction, and a Charpy impact test was conducted at −40° C. to evaluate absorbed energy. The results of the tensile test and the Charpy impact test conducted in the above-described test are given in Table 2.

TABLE 2

| Steel No. | Quenching temperature (° C.) | Tempering temperature (° C.) | Yield strength (MPa) | Tensile strength (MPa) | Absorbed energy (J) |
|---|---|---|---|---|---|
| 1 | 920 | 600 | 952 | 1000 | 45 |
| 2 | 920 | 650 | 926 | 970 | 50 |
| 3 | 920 | 650 | 925 | 967 | 182 |
| 4 | 920 | 650 | 964 | 1012 | 156 |
| 5 | 920 | 500 | 969 | 1002 | 52 |
| 6 | 920 | 500 | 928 | 989 | 50 |
| 7 | 920 | 680 | 955 | 1060 | 35 |
| 8 | 920 | 680 | 890 | 950 | 55 |
| 9 | 920 | 600 | 980 | 1060 | 140 |
| 10 | 920 | 650 | 975 | 1035 | 150 |
| 11 | 920 | 650 | 990 | 1050 | 200 |
| 12 | 920 | 670 | 900 | 980 | 35 |
| 13 | 920 | 650 | 970 | 1020 | 200 |

TABLE 2-continued

| Steel No. | Quenching temperature (° C.) | Tempering temperature (° C.) | Yield strength (MPa) | Tensile strength (MPa) | Absorbed energy (J) |
|---|---|---|---|---|---|
| 14 | 920 | 600 | 970 | 1000 | 130 |
| 15 | 920 | 670 | 975 | 1035 | 28 |
| 16 | 920 | 660 | 970 | 1013 | 100 |
| 17 | 920 | 670 | 970 | 1005 | 160 |
| 18 | 920 | 550 | 900 | 955 | 34 |

As the result, the present inventors obtained findings of the following items (a) to (h) concerning a method capable of improving low-temperature toughness of even a seamless steel pipe having a tensile strength of 950 MPa or more.

(a) From the test results of Steel Nos. 1 to 4, the effect of B was revealed. In Steel Nos. 1 and 2 containing about 0.0015% of B, the absorbed energy was at a low level as compared with Steel Nos. 3 and 4 containing an extremely small amount of B, being 0.0001%. The reason for this is thought to be that if both of Cr and B are contained to obtain high strength, during tempering, coarse borides are formed at crystal grain boundaries, and the toughness is decreased with the boride being the starting point of brittle fracture. Therefore, it was found that in the case where a tensile strength of 950 MPa or more is obtained by quench and temper, the content of B must be decreased to the utmost to improve the low-temperature toughness.

(b) From the test results of Steel Nos. 5 to 7, the effect of Cr and Mo was revealed. Steel Nos. 5 and 6 were tempered at a low temperature to obtain high strength because the content of Mo or Cr was low; the low temperature tempering led to a low absorbed energy. On the other hand, Steel No. 7 was able to be tempered at a high temperature because the contents of Cr and Mo were high, but the absorbed energy was at a low level because the contents of Cr and Mo were excessively high. Therefore, it was found that in the case where a tensile strength of 950 MPa or more is obtained by quench and temper, Cr and Mo must be contained in proper amounts to improve the low-temperature toughness.

(c) From the test results of Steel Nos. 8 to 11, the effect of Cu and Ni was revealed. For Steel No. 8, the absorbed energy was at a low level because the content of each of Cu and Ni was low, being 0.01%. On the other hand, for Steel Nos. 9 to 11, the absorbed energy was high, and the contents of Cu and Ni were proper. Therefore, it was found that in the case where a tensile strength of 950 MPa or more is obtained by quench and temper, a proper amount of Ni or proper amounts of Ni and Cu must be contained to improve the low-temperature toughness.

(d) From the test results of Steel Nos. 12 to 15, the effect of V, Ti and Nb was revealed. For Steel No. 12, the absorbed energy was at a low level because the contents of V, Ti and Nb were low. On the other hand, for Steel No. 15, the absorbed energy was at a low level because the V content was too high. Therefore, it was found that in the case where a tensile strength of 950 MPa or more is obtained by quench and temper, V, Ti and Nb must be contained in proper amounts to improve the low-temperature toughness.

(e) From the test results of Steel Nos. 16 and 17, the effect of Mn was revealed. For both the steel numbers, although the Mn content was rather low, the absorbed energy was high, and the low-temperature toughness was excellent as compared with a general steel for a seamless steel pipe for line pipe manufactured by quench and temper similar to that of the present invention.

(f) From the test results of Steel No. 18, the effect of S was revealed. For Steel No. 18, the absorbed energy was at a low level because the S content was excessively high. The reason for this is thought to be that S contained as an impurity reacts with Mn in the manufacturing process to produce MnS, and this MnS exerts an adverse effect on the toughness of quenched and tempered steel having a high strength. Therefore, the S content must be decreased. To decrease the S content, raw ore and scrap containing a small amount of S have only to be used, or Ca or Mg has only to be contained in molten steel during steel making to reduce S. As the result, the production of MnS can be suppressed.

(g) As for other components, Al is effective in enhancing the toughness and workability of steel. Therefore, a proper amount of Al should be contained. P and N in the impurities are elements that decrease the toughness. Therefore, the contents of P and N must be restrained.

(h) From the above results, it was found that an extremely excellent low-temperature toughness can be secured after quench and temper by using a low-alloy steel, which contains proper amounts of Ni, Cu, Cr, Mo, Nb and Al without containing P, S, N and B to the utmost in the range of carbon amount proper to weldability for the application to a machine structural member such as a crane boom.

The present invention was completed based on the above-described findings, and the gist thereof resides in the seamless steel pipes according to the items (1) and (2), and the method for manufacturing a seamless steel pipe according to the item (3) as described below.

(1) A seamless steel pipe of a low-alloy steel consisting, by mass %, of C: 0.10 to 0.20%, Si: 0.05 to 1.0%, Mn: 0.05 to 1.2%, Ni: 0.02 to 1.0%, Cr: 0.50 to 1.50%, Mo: 0.50 to 1.50%, Nb: 0.002 to 0.10%, Al: 0.005 to 0.10%, and either or both of Ti: 0.003 to 0.050% and V: 0.01 to 0.20%, the balance being Fe and impurities, the impurities containing 0.025% or less of P, 0.005% or less of S, 0.007% or less of N, and less than 0.0003% of B, wherein the tensile strength is 950 MPa or more and the yield strength is 850 MPa or more, and the Charpy absorbed energy at −40° C. is 60 J or more.

(2) The seamless steel pipe according to the item (1), which further contains Cu: 0.02 to 1.0% in place of some of Fe, wherein the tensile strength is 950 MPa or more and the yield strength is 850 MPa or more, and the Charpy absorbed energy at −40° C. is 60 J or more.

(3) The seamless steel pipe according to the item (1) or (2), which further contains either or both of Ca: 0.0005 to 0.0050% and Mg: 0.0005 to 0.0050% in place of some of Fe, wherein the tensile strength is 950 MPa or more and the yield strength is 850 MPa or more, and the Charpy absorbed energy at −40° C. is 60 J or more.

(4) The seamless steel pipe according to any one of the items (1) to (3), wherein the wall thickness is 8 mm or more, the tensile strength is 950 MPa or more and the yield strength is 850 MPa or more, and the Charpy absorbed energy at −40° C. is 60 J or more.

(5) The seamless steel pipe according to the item (4), wherein the wall thickness is 20 mm or more, the tensile strength is 950 MPa or more and the yield strength is 850 MPa or more, and the Charpy absorbed energy at −40° C. is 60 J or more.

(6) A method for manufacturing a seamless steel pipe having a tensile strength of 950 MPa or more, a yield strength of 850 MPa or more, and Charpy absorbed energy at −40° C. of 60 J or more, in which a low-alloy steel having the alloy composition described in any one of the items (1) to (3) is worked into a steel pipe shape at a high temperature, and the steel pipe is heated from room temperature to a temperature of not lower than the $Ac_3$ transformation point and quenched, and thereafter is tempered at a temperature of not higher than the $Ac_1$ transformation point.

ADVANTAGEOUS EFFECTS OF INVENTION

According to the present invention, there can be provided a seamless steel pipe having a tensile strength of 950 MPa or more, a yield strength of 850 MPa or more, and a high toughness. This seamless steel pipe can be used for a machine structural member, especially for a crane, for example.

BRIEF DESCRIPTION OF DRAWINGS

FIG. 1 is a sectional view showing a groove shape in a welding test.

DESCRIPTION OF EMBODIMENTS

Hereunder, the reason why the chemical components of a seamless steel pipe in accordance with the present invention are limited is described. In the following description, "%" relating to the content means "mass %".

C: 0.10 to 0.20%

C (Carbon) is an element having an effect of enhancing the strength of steel. If the C content is lower than 0.1%, in order to obtain a desired strength, tempering at a low temperature is required, which results in a decrease in toughness. On the other hand, if the C content exceeds 0.20%, the weldability decreases remarkably. Therefore, the C content should be 0.10 to 0.20%. The lower limit of the C content is preferably 0.12%, more preferably 0.13%. Also, the upper limit of the C content is preferably 0.18%.

Si: 0.05 to 1.0%

Si (Silicon) is an element having a deoxidation effect. Also, this element enhances the hardenability of steel, and improves the strength thereof. In order to achieve these effects, 0.05% or more of Si must be contained. However, if the Si content exceeds 1.0%, the toughness and weldability decrease. Therefore, the Si content should be 0.05 to 1.0%. The lower limit of the Si content is preferably 0.1%, more preferably 0.15%. Also, the upper limit of the Si content is preferably 0.60%, more preferably 0.50%.

Mn: 0.05 to 1.2%

Mn (Manganese) is an element having a deoxidation effect. Also, this element enhances the hardenability of steel, and improves the strength thereof. In order to achieve these effects, 0.05% or more of Mn must be contained. However, if the Mn content exceeds 1.2%, the toughness decreases. Therefore, the Mn content should be 0.05 to 1.2%.

Ni: 0.02 to 1.5%

Ni (Nickel) has an effect of improving the hardenability to increase the strength and enhancing the toughness. In order to achieve the effect, 0.02% or more of Ni must be contained. However, the Ni content exceeding 1.5% is disadvantageous in terms of economy. Therefore, the Ni content should be 0.02 to 1.5%. The lower limit of the Ni content is preferably 0.05%, more preferably 0.1%. Also, the upper limit of the Ni content is preferably 1.3%, more preferably 1.15%. Especially in the case of a thick-wall steel pipe having a wall thickness exceeding 25 mm, Ni content of 0.50% or more may make it easier to secure desired high strength and toughness.

Cr: 0.50 to 1.50%

Cr (Chromium) is an element effective in enhancing the hardenability and temper softening resistance of steel to improve the strength thereof. For a high-strength steel pipe having a tensile strength of 950 MPa or more, in order to achieve the effect, 0.50% or more of Cr must be contained. However, the Cr content exceeding 1.50% leads to a decrease in toughness. Therefore, the Cr content should be 0.50 to 1.50%. The lower limit of the Cr content is preferably 0.60%, more preferably 0.80%. Also, the upper limit of the Cr content is preferably 1.40%.

Mo: 0.50 to 1.50%

Mo (Molybdenum) is an element effective in enhancing the hardenability and temper softening resistance of steel to improve the strength thereof. For a high-strength steel pipe having a tensile strength of 950 MPa or more, in order to achieve the effect, 0.50% or more of Mo must be contained. However, the Mo content exceeding 1.50% leads to a decrease in toughness. Therefore, the Mo content should be 0.50 to 1.50%. The lower limit of the Mo content is preferably 0.70%. Also, the upper limit of the Mo content is preferably 1.0%.

As described above, the present invention employs a way for improving the strength by relying on Cr and Mo to enhance the hardenability and temper softening resistance of steel. The contents of Cr and Mo are such that the total amount of Cr+Mo preferably exceeds 1.50%, and more preferably exceeds 1.55%.

Nb: 0.002 to 0.10%

Nb (Niobium) is an element having an effect of improving the toughness by forming carbo-nitrides in a high-temperature zone and by restraining the coarsening of crystal grains. In order to achieve the effect, 0.002% or more of Nb is preferably contained. However, if the Nb content exceeds 0.10%, the carbo-nitrides become too coarse, so that the toughness rather decreases. Therefore, the Nb content should be 0.002 to 0.10%. The upper limit of the Nb content is preferably 0.05%.

Al: 0.005 to 0.10%

Al (Aluminum) is an element having a deoxidation effect. This element has an effect of enhancing the toughness and workability of steel. The Al content may be at an impurity level. However, in order to achieve the effects reliably, 0.005% or more of Al is preferably contained. However, if the Al content exceeds 0.10%, marco-streak-flaws occur remarkably. Therefore, the Al content should be 0.10% or less. Therefore, the Al content should be 0.005 to 0.10%. The upper limit of the Al content is preferably 0.05%. The Al content in the present invention is the content of acid-soluble Al (so-called sol.Al).

Concerning Ti and V, either or both of Ti and V must be contained.

Ti: 0.003 to 0.050%

Ti (Titanium) has an effect of improving the strength by precipitating as Ti carbides during tempering. In order to achieve this effect, 0.003% or more of Ti must be contained. However, if the Ti content exceeds 0.050%, coarse carbo-nitrides are formed in a high-temperature zone during solidification, and also the precipitation amount of Ti carbides during tempering becomes excessive, so that the toughness decreases. Therefore, the Ti content should be 0.003 to 0.050%.

V: 0.01 to 0.20%

V (Vanadium) has an effect of improving the strength by precipitating as V carbides during tempering. In order to achieve this effect, 0.01% or more of V must be contained. However, if the V content exceeds 0.20%, the precipitation amount of V carbides during tempering becomes excessive, so that the toughness decreases. Therefore, the V content should be 0.01 to 0.20%. The upper limit of the V content is preferably 0.15%.

For the seamless steel pipe in accordance with the present invention, in addition to the above-described components, the balance is Fe and impurities. The impurities are components that mixedly enter from raw ore, scrap, and the like, and are acceptable as far as the impurities do not exert an adverse effect on the present invention. However, in particular, concerning P, S, N and B in the impurities, the contents thereof must be restrained as described below.

P: 0.025% or Less

P (Phosphorus) is an element existing in steel as an impurity. If the P content exceeds 0.025%, the toughness decreases remarkably. Therefore, the upper limit as an impurity should be 0.025%.

S: 0.005% or Less

S (sulfur) is, like P, an element existing in steel as an impurity. If the S content exceeds 0.005%, the toughness decreases remarkably. Therefore, the upper limit as an impurity should be 0.005%. The upper limit of the S content is preferably 0.003%.

N: 0.007% or Less

N (Nitrogen) is an element existing in steel as an impurity. If the N content exceeds 0.007%, the toughness decreases remarkably. Therefore, the upper limit as an impurity should be 0.007%.

B: Less than 0.0003%

B (Boron) is an element having an effect of usually enhancing the strength by improving the hardenability by being contained. However, if not less than 0.0003% of B is contained in a steel containing certain amounts of Cr and Mo, coarse borides are formed during tempering, and thereby the toughness is decreased. In the present invention, therefore, the upper limit of B as an impurity should be less than 0.0003%.

The seamless steel pipe in accordance with the present invention may further contain Cu, if necessary, in addition to the above-described components. Also, if necessary, either or both of Ca and Mg may be contained further.

TABLE 3

| Steel | Chemical composition (mass %, the balance being Fe and impurities) | | | | | | | | | | | | | | | | | $Ac_1$ point | $Ac_3$ point |
|---|---|---|---|---|---|---|---|---|---|---|---|---|---|---|---|---|---|---|---|
| No. | C | Si | Mn | P | S | Cu | Ni | Cr | Mo | V | Ti | Nb | Ca | Mg | B | sol-Al | N | (° C.) | (° C.) |
| 19 | 0.14 | 0.29 | 1.00 | 0.015 | 0.0012 | | 0.03 | 1.00 | 0.70 | 0.05 | 0.006 | 0.029 | 0.0017 | | | 0.031 | 0.0053 | 780 | 889 |
| 20 | 0.15 | 0.28 | 1.00 | 0.015 | 0.0012 | | 0.50 | 1.00 | 0.70 | 0.05 | 0.006 | 0.029 | 0.0015 | | | 0.033 | 0.0050 | 768 | 870 |
| 21 | 0.15 | 0.29 | 1.00 | 0.016 | 0.0013 | | 1.00 | 1.00 | 0.70 | 0.05 | 0.006 | 0.030 | 0.0014 | | | 0.033 | 0.0053 | 757 | 857 |
| 22 | 0.12 | 0.29 | 1.00 | 0.016 | 0.0015 | | 1.00 | 1.10 | 0.70 | 0.05 | 0.005 | 0.030 | 0.0018 | | | 0.033 | 0.0050 | 755 | 864 |

Cu: 0.02 to 1.0%

Cu (Copper) has an effect of enhancing the strength by precipitating during tempering. This effect is remarkable when the Cu content is 0.02% or more. On the other hand, if the Cu content exceeds 1.0%, defects occur frequently on the surface of steel pipe. Therefore, the content in the case where Cu is contained should be 0.02 to 1.0%. The lower limit of the Cu content is preferably 0.05%, more preferably 0.10%. Also, the upper limit of the Cu content is preferably 0.50%, more preferably 0.35%.

Ca: 0.0005 to 0.0050%

Ca (Calcium) has an effect of improving the form of inclusions by forming sulfides by reacting with S in steel, and thereby increasing the toughness of steel. This effect is remarkable when the Ca content is 0.0005% or more. On the other hand, if the Ca content exceeds 0.0050%, the amount of inclusions in steel increases, and the cleanliness of steel decreases, so that the toughness rather decreases. Therefore, in the case where Ca is contained, the content thereof should preferably be 0.0005 to 0.0050%.

Mg: 0.0005 to 0.0050%

Mg (Magnesium) also has an effect of improving the form of inclusions by forming sulfides by reacting with S in steel, and thereby increasing the toughness of steel. This effect is remarkable when the Mg content is 0.0005% or more. On the other hand, if the Mg content exceeds 0.0050%, the amount of inclusions in steel increases, and the cleanliness of steel decreases, so that the toughness rather decreases. Therefore, in the case where Mg is contained, the content thereof should preferably be 0.0005 to 0.0050%.

Next, a method for manufacturing the steel pipe in accordance with the present invention is described.

The pipe making means is not subject to any special restriction. The pipe may be made by, for example, a piercing, rolling, and elongating process at a high temperature, or may be made by a hot extrusion press.

As the heat treatment for providing strength and toughness, quenching and tempering are performed. The quenching is performed by heating the pipe to a temperature of not lower than the $Ac_3$ transformation point of the steel and thereafter by rapidly cooling the pipe. As the heating for the quenching, ordinary heating in furnace may be performed, and preferably, rapid heating using induction heating may be performed. Also, as the rapid cooling method, water cooling, oil cooling, or the like is used. The tempering is performed by heating and soaking the pipe at a temperature of lower than the $Ac_1$ transformation point of the steel, and thereafter by air cooling the pipe. The soaking temperature for tempering is preferably 550° C. or more because if the temperature is too low, embrittlement may occur.

EXAMPLE 1

For each of the steel types given in Table 3, a 100-kg ingot was prepared by vacuum melting.

This ingot was hot forged into a block shape, and thereafter was heated at 1250° C. for 30 minutes and hot rolled in the temperature range of 1200 to 1000° C. to obtain plates having thicknesses of 20 mm, 30 mm, and 45 mm. These plates were soaked under the condition of 920° C. and 10 minutes, thereafter being quenched by water cooling, and were further tempered to obtain heat-treated plates. The tempering was performed by soaking under either condition of 600° C. or 650° C. for 30 minutes.

A No. 10 test specimen specified in JIS Z2201 (1998) was cut out of the central portion in the wall thickness direction of each of the heat-treated plates in parallel to the roll longitudinal direction, and a tensile test was conducted in conformity to JIS Z2241 (1998). Also, a 2-mm V-notch full size test specimen conforming to JIS Z2242 was cut out of the central portion in the wall thickness direction of each of the heat-treated plates in parallel to the roll width direction, and a Charpy impact test was conducted at −40° C. to evaluate absorbed energy. The results of the tensile test and the Charpy impact test conducted in the above-described test are given in Table 4.

TABLE 4

| Steel No. | Thickness (mm) | Soaking temp. for quenching (° C.) | Tempering temp. (° C.) | Yield strength (MPa) | Tensile strength (MPa) | Absorbed energy (J) |
|---|---|---|---|---|---|---|
| 19 | 20 | 920 | 650 | 963 | 1024 | 144 |
| 19 | 30 | 920 | 650 | 910 | 972 | 179 |
| 19 | 45 | 920 | 600 | 863 | 987 | 31* |
| 20 | 20 | 920 | 650 | 937 | 987 | 185 |
| 20 | 30 | 920 | 650 | 964 | 1013 | 187 |
| 20 | 45 | 920 | 650 | 916 | 979 | 80 |
| 21 | 20 | 920 | 650 | 1021 | 1064 | 70 |
| 21 | 30 | 920 | 650 | 966 | 1005 | 172 |
| 21 | 45 | 920 | 650 | 979 | 1036 | 97 |
| 22 | 20 | 920 | 650 | 891 | 956 | 63 |
| 22 | 30 | 920 | 650 | 915 | 969 | 196 |
| 22 | 45 | 920 | 650 | 897 | 957 | 154 |

*shows out of the scope of the invention.

Steel No. 19 has the chemical composition of the steel in accordance with the present invention, and the Ni content thereof is low, being 0.03%. In the case where the wall thicknesses were 20 mm and 30 mm, satisfactory strength and toughness were obtained. However, in the case where the wall thickness was 45 mm, the absorbed energy was at a low level, being 31 J, so that satisfactory toughness was unable to be secured. Steel Nos. 20 to 22 have the chemical composition of the steel in accordance with the present invention, and each contain 0.50% or more of Ni. In the case where the wall thickness was 45 mm as well, desired high strength and toughness were obtained.

Thus, it was revealed that the increase in Ni concentration is effective especially in the case of large wall thickness. Also, at the same time, it was revealed that the objective achieved even if Cu is not contained.

EXAMPLE 2

A steel having the chemical composition given in Table 5 was melted, and was cast by a converter-continuous casting process to form a rectangular billet and a columnar billet, respectively, having an outside diameter of 310 mm. The rectangular billet was further hot forged to form a columnar billet having an outside diameter of 170 mm and a columnar billet having an outside diameter of 225 mm.

TABLE 5

| Chemical composition (mass %, the balance being Fe and impurities) | | | | | | | | | | | | | | | |
|---|---|---|---|---|---|---|---|---|---|---|---|---|---|---|---|
| C | Si | Mn | P | S | Cu | Ni | Cr | Mo | V | Ti | Nb | Ca | B | Al | N |
| 0.16 | 0.31 | 1.01 | 0.010 | 0.0016 | 0.03 | 0.02 | 0.98 | 0.70 | 0.06 | 0.012 | 0.029 | 0.0015 | 0.0001 | 0.039 | 0.0039 |

These columnar billets were heated to 1240° C., and seamless steel pipes having the dimensions shown in Table 6 were produced by the Mannesmann-mandrel process. Thereafter, quench and temper heat treatment was performed under the temperature conditions shown in Table 6 to manufacture product steel pipes. For each of the obtained product steel pipes, the strength characteristics at both end positions (the front end side in the roll direction is referred to as a T end, and the rear end side as a B end) in the longitudinal direction were evaluated by conducting a tensile test conforming to JIS Z2241 by using a No. 12 test specimen specified in JIS Z2201, and the toughness was evaluated as the lowest absorbed energy among three test specimens by cutting out a 2-mm V-notch full size test specimen conforming to JIS Z2242 and by conducting a Charpy impact test at −40° C. Table 6 gives the evaluation results of strength and toughness of each of the product steel pipes. For all the steel pipes having different dimensions, satisfactory results such that the yield strength was 850 MPa or more, the tensile strength was 950 MPa or more, and the Charpy absorbed energy at −40° C. was 60 J or more were obtained.

TABLE 6

| Outer diameter (mm) | Thickness (mm) | Soaking temp. for quenching (° C.) | Tempering temp. (° C.) | Evaluating position | Yield strength (MPa) | Tensile strength (MPa) | Absorbed energy (J) |
|---|---|---|---|---|---|---|---|
| 219.1 | 15.0 | 920 | 625 | T end | 1017 | 1132 | 62 |
| | | | | B end | 1001 | 1119 | 68 |
| | | | 650 | T end | 956 | 1058 | 104 |
| | | | | B end | 953 | 1053 | 152 |
| 168.3 | 12.0 | 920 | 600 | T end | 1036 | 1107 | 64 |
| | | | | B end | 1037 | 1114 | 67 |
| | | | 625 | T end | 1018 | 1083 | 84 |
| | | | | B end | 1014 | 1084 | 120 |
| | | | 650 | T end | 987 | 1045 | 144 |
| | | | | B end | 962 | 1023 | 139 |
| 273 | 25.0 | 920 | 625 | T end | 1005 | 1086 | 87 |
| | | | | B end | 997 | 1078 | 102 |
| | | | 650 | T end | 980 | 1075 | 98 |
| | | | | B end | 975 | 1068 | 102 |

T end: the front end side in the roll direction.
B end: the rear end side in the roll direction.

Of the steel pipes produced by the above-described method, the steel pipe having an outside diameter of 219.1 mm and a wall thickness of 15.0 mm (tempered at 650° C.) was used, and welding was performed in the circumferential direction to conduct a welding test. The welding conditions are given in Table 7, and the groove shape is shown in FIG. 1.

TABLE 7

| | | | | | | | |
|---|---|---|---|---|---|---|---|
| Welding method | Automatic MAG welding | | | | | | |
| Welding figure | Down direction | | | | | | |
| Welding material | YM-100A (Diameter: 1.2 mm) | | | | | | |
| Shielding gas | Ar + 20% $CO_2$ | | | | | | |
| | Welding | Targeted heat input (kJ/cm) | Passing number | Welding current (A) | Welding voltage (V) | Welding speed (cm/min | Welding heat input (kJ/cm) |
| Welding condition | MAG | 10 | 1-5 | 190 | 27 | 26 | 11.8 |
| | | 15 | 1-5 | 200 | 27 | 22 | 14.7 |
| Pre-heating temp. | 100° C. | | | | | | |
| Temparature between passes | 150° C. or less | | | | | | |
| PWHT | None | | | | | | |

From the obtained welded joint, a No. 3A test specimen (width: 20 mm, parallel length: 30 mm+maximum width of welded metal surface+30 mm) specified in JIS Z3121 was prepared, and a tensile test was conducted. As the result of welded joint tensile test, the tensile strength was at a satisfactory level, being 972 MPa or more at a heat input of 12 KJ/cm and 1002 MPa or more at a heat input of 15 KJ/cm.

As described above, concerning the characteristics after welding as well, the steel pipe in accordance with the present invention was at a satisfactory level.

INDUSTRIAL APPLICABILITY

The seamless steel pipe in accordance with the present invention has a high strength: the tensile strength of 950 MPa or more and the yield strength of 850 MPa or more, and is excellent in toughness at a low temperature. Therefore, the seamless steel pipe can be used for a machine structural member, especially for a crane boom preferably.

The invention claimed is:

1. A seamless low-alloy steel pipe comprising, in percent by mass, C: 0.10 to 0.18%, Si: 0.05 to 1.0%, Mn: 0.05 to 1.2%, Ni: 0.05 to 1.5%, Cr: 0.50 to 1.50%, Mo: 0.50 to 1.50%, Nb: 0.002 to 0.10%, Al: 0.005 to 0.10%, and either or both of Ti: 0.003 to 0.050% and V: 0.01 to 0.20%, the balance being Fe and impurities, the impurities containing 0.025% or less of P, 0.005% or less of S, 0.007% or less of N, and less than 0.0003% of B, wherein a wall thickness of the pipe is 20 mm or more, the tensile strength is 950 MPa or more and the yield strength is 850 MPa or more, and the Charpy absorbed energy at −40° C. is 60 J or more.

2. The seamless low-alloy steel pipe according to claim 1, which further contains either or both of Ca: 0.0005 to 0.0050% and Mg: 0.0005 to 0.0050%.

3. A seamless low-alloy steel pipe comprising, in percent by mass, C: 0.10 to 0.18%, Si: 0.05 to 1.0%, Mn: 0.05 to 1.2%, Ni: 0.02 to 1.5%, Cr: 0.50 to 1.50%, Mo: 0.50 to 1.50%, Nb: 0.002 to 0.10%, Cu: 0.02 to 1.0% Al: 0.005 to 0.10%, and either or both of Ti: 0.003 to 0.050% and V: 0.01 to 0.20%, the balance being Fe and impurities, the impurities containing 0.025% or less of P, 0.005% or less of S, 0.007% or less of N, and less than 0.0003% of B, wherein the wall thickness is 20 mm or more, the tensile strength is 950 MPa or more and the yield strength is 850 MPa or more, and the Charpy absorbed energy at −40° C. is 60 J or more.

4. The seamless steel pipe according to claim 3, which further contains either or both of Ca: 0.0005 to 0.0050% and Mg: 0.0005 to 0.0050%.

5. A method for manufacturing a seamless low-alloy steel pipe with a wall thickness of 20 mm or more, having a tensile strength of 950 MPa or more, a yield strength of 850 MPa or more, and Charpy absorbed energy at −40° C. of 60 J or more, comprising:

providing a low-alloy steel having the alloy composition according to any one of claims 1, 2, 3 or 4, hot working the low alloy steel into a steel pipe having a diameter and a wall thickness of 20 mm or more at a high temperature, and then heating the steel pipe with said diameter and wall thickness from room temperature to a temperature of not lower than the $Ac_3$ transformation point, and quenching the heated steel pipe, and tempering the quenched steel pipe at a temperature of not higher than the $Ac_1$ transformation point.

* * * * *